United States Patent [19]

Incitti

[11] Patent Number: 4,696,282

[45] Date of Patent: Sep. 29, 1987

[54] CAMP STOVE

[76] Inventor: Corkey Incitti, Weston, Colo. 81091

[21] Appl. No.: 918,208

[22] Filed: Oct. 14, 1986

[51] Int. Cl.[4] ..... F24C 1/16

[52] U.S. Cl. ..... 126/9 R; 126/25 R; 126/37 B; 126/275 R

[58] Field of Search ..... 126/2, 29, 30, 9 R, 126/9 A, 9 B, 25 R, 37 B, 50, 246, 261, 265, 275 R, 37 R

[56] References Cited

U.S. PATENT DOCUMENTS

| | | | |
|---|---|---|---|
| 1,072,231 | 9/1913 | Howell | 126/30 X |
| 1,364,371 | 1/1921 | Highan | 126/29 |
| 1,830,230 | 11/1931 | Gwyer | 126/30 X |
| 2,211,924 | 8/1940 | Foster | 126/2 X |
| 2,631,579 | 3/1953 | Metzger | 126/9 R |
| 2,791,959 | 5/1957 | Pirz | 126/25 R |
| 2,907,316 | 10/1959 | Windust | 126/9 R |
| 3,005,451 | 10/1961 | Richart | 126/9 R |
| 3,064,637 | 11/1962 | Thomson | 126/9 R |
| 3,124,057 | 3/1964 | Kiser | 126/9 R |
| 3,172,402 | 3/1965 | Valiela | 126/25 R |
| 3,610,225 | 10/1971 | Schwanter | 126/25 R |
| 4,092,973 | 6/1978 | Bernazzani | 126/9 R |
| 4,158,992 | 6/1979 | Malafouris | 126/9 R |
| 4,205,652 | 6/1980 | Pjarris | 126/9 R |
| 4,369,763 | 1/1983 | Sullivan | 126/37 R |

*Primary Examiner*—Samuel Scott
*Assistant Examiner*—H. A. Odar
*Attorney, Agent, or Firm*—John E. Toupal; Harold G. Jarcho

[57] ABSTRACT

A camp stove including a metallic framework defining a primary fire chamber straddled by first and second auxiliary fire chambers; a metallic grate supported by the framework above the primary fire chamber; a first metallic grill supported by the framework and slidable thereon between one position above the first auxiliary fire chamber and another position over and directly adjacent to the grate; and a second metallic grill supported by the framework above the second auxiliary fire chamber.

8 Claims, 5 Drawing Figures

CAMP STOVE

BACKGROUND OF THE INVENTION

This invention relates generally to a camp stove and, more particularly, to a portable camp stove that facilitates a wide variety of cooking operations.

The availability of a camp stove is highly desirable during most camping and picnicing excursions. However, camp stoves are not present in many of the sites suitable for either camping or picnicing. Furthermore, even when available, conventional camp stoves are quite rudimentary and substantially limit the types of cooking procedures that can be performed. a typical camp stove, for example, consists of either a grill or a gate or a combination thereof supported above a fire pit. Such a stove allows little flexibility during cooking operations.

The object of this invention, therefore, is to porvide an improved, more useful camp stove.

SUMMARY OF THE INVENTION

The invention is a camp stove including a metallic framework defining a primary fire chamber straddled by first and second auxiliary fire chambers; a metallic grate supported by the framework above the primary fire chamber; a fire metallic griddle plate supported by the framework and slidable thereon between one position above the first auxiliary fire chamber and another position over and directly adjacent to the grate; and a second metallic griddle plate supported by the framework above the second auxiliary fire chamber. This arrangement provides an extremely versatile camp stove.

According to certin features of the invention, the camp stove includes a first handle secured to the first griddle plate at an end thereof opposite to the second grill, and a second handle secured to the second griddle plate at an end thereof opposite to the first grill. The first and second handles enhance the portability of the stove and the first handle additionally facilitates manual adjustment of the first grill.

According to another feature of the invention, the stove includes a metallic oven enclosure supported by the framework and slidable between a position below the second griddle plate and a position projecting from the framework in a zone spaced from the fire chambers. The provision of an adjustable oven enclosure furher enhances the versatility of the stove.

According to yet another feature of the invention, the framework comprises an upper frame supporting the grills and the grate, a plurality of legs each have one end fixed to the upper frame, and a lower frame fixed to opposite ends of the legs and adapted to support the stove on a ground surface. The framework establishes structural stability for the stove.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figures 1, 2, 3, 4, 5:
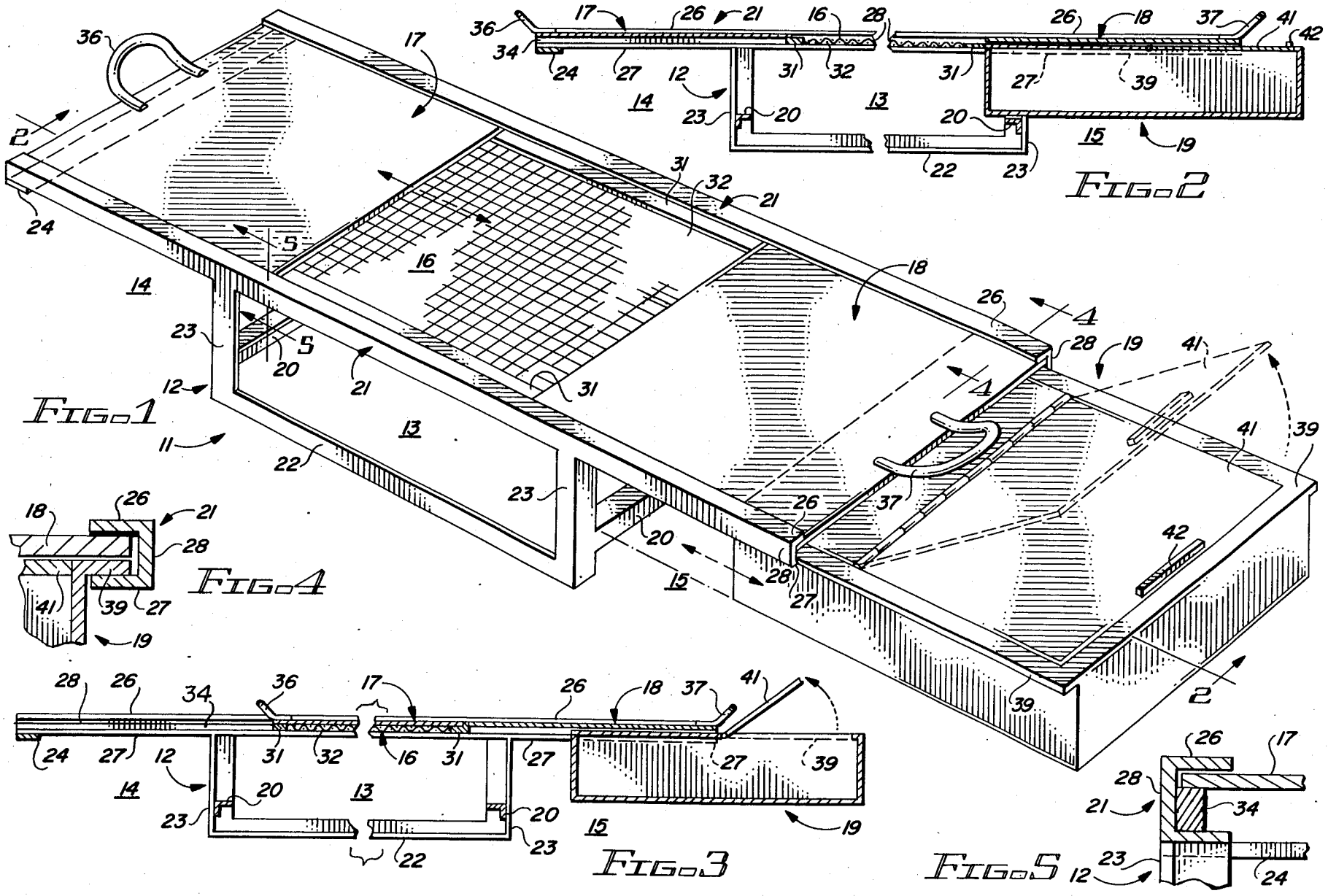
FIG. 1 is a schematic perspective view of a camp stove constructed in accordance with the invention.
FIG. 2 is a schematic partial cross-sectional view taken along lines 2—2 of FIG. 1.
FIG. 3 is a schematic sectional view similr to that shown in FIG. 2 but with particular components of the stove in different operating positions.
FIG. 4 is a schematic cross-sectional view taken along lines 4—4 of FIG. 2.
FIG. 5 is a schematic cross-sectional view taken along lines 5—5 of FIG. 2.

A camp stove 11 includes a metallic framework 12 that defines a primary fire chamber 13 straddled by auxiliary first and second fire chambers 14, 15 respectively. Supported by the framework 12 above the primary fire chamber 13 is a metallic grate 16 suitable for broiling food products. A first metallic griddle plate 17 also is supported by the framework 12 and is slidable thereon between one position above the first auxiliary fire chamber 14 and another position over and directly adjacent to the grate 16. Also supported by the frame 12 is a second metallic griddle plate 18 positioned above the second auxiliary fire chamber 15. Both the first and second griddle plates 17 and 18 are suitable for grilling food products. The camp stove 11 further includes a metallic oven enclosure 19 supported by the framework 12 and slidable thereon between a position in the second auxiliary fire chamber 15 below the second auxiliary griddle plate 18 and a position projecting from the framework 12 in a zone spaced from the fire chambers 13-15.

The framework 12 consists of an upper frame formed by a pair of parallel U channels 21 and a lower frame formed by a pair of spaced apart elongate angle irons 22 each disposed and extending parallel to one of the U channels 21. Joining the upper frame 21 and the lower frame 22 are a plurality of metallic legs 23, each having one end fixed to one of the U channels 21 and an opposite end fixed to one of the angle irons 22. A cross-member 20 connects mid-portions of each transversely spaced apart pair of legs 23, and a cross-piece 24 connects ends of the U channels 21.

As shown in FIG. 2, each of the U channels 21 comprises inwardly projecting, spaced apart upper and lower flange portions 26, 27, respectively, joined by an outer web portion 28. The grate 16 includes solid opposite edges 31 of slightly greater thickness than a perforated central portion 32. Supporting the solid edges 31 of the grate 16 are the lower flange portions 27 of the U-channels 21. A spacer plate 34 is supported by the lower flange portion 27 of each of the U channels 21 directly above the first auxiliary fire chamber 14. The spacer plates 34 have the same thickness as and are aligned with the solid edges 31 of the grate 16. Opposite edges of the first griddle plate 17 are supported by and slidable on the upper surfaces of the spacer plates 34 and the grate edges 31 between one position (FIG. 2) above the first auxiliary fire chamber 14 and a position (FIG. 3) over and directly adjacent to the grate 16. Fixed to an end of the first griddle plate 17 opposite to the second griddle plate 18 is a handle 36.

Extending between and fixed to the bottom surfaces of the upper flange portions 26 are opposite edges of the second griddle plate 18. A handle 37 is fixed to an end of the second griddle plate 18 opposite to the first griddle plate 17. Extending laterally from opposite upper edges of the oven enclosure 19 are shoulder portions 39 that are supported by upper surfaces of the lower flange portions 27 of the U channels 21. The shoulder portions 39 are slidable on the lower flange portions 27 between a position (FIG. 2) in the second auxiliary fire chamber 15 and below the second grill 18 and a position (FIG. 3) projecting from the framework 12 in a zone spaced from the fire chambers 13-15. In the latter position, a hinged cover 41 having a handle 42 can be moved into an open position as shown in FIG. 3.

During typical use of the stove 11, a suitable fuel such as wood, charcoal or coal is positioned within the primary fire chamber 13 and the first auxiliary fire chamber 14 and ignited to provide a source of heat. The upper surface of the grate 16 then is used to broil food products while the first griddle plate 17 is used to cook food products for which a grilling operation is desired. In addition, the oven enclosure 19 can be moved into the position of FIG. 3 and the cover 41 opened to provide access thereto. After insertion of food products for which either a baking or warming operation is desired, the oven enclosure 19 can be moved back into the position of FIG. 2 to be warmed by the fire in the primary fire chamber 13. The temperature within the oven enclosure 19 can be adjusted by positioning thereof in positions intermediate those shown in FIGS. 2 and 3.

For occasions on which the full surface capacity of the grate 16 and the first griddle plate 17 are not required, a fire can be generated only in the primary fire chamber 13. In those cases, the distribution of griddle and grate surface above the primary fire chamber 13 can be selectively adjusted by movement of the first griddle plate 17 into positions intermediate to those shown in FIGS. 2 and 3. Conversely, if increased cooking surface is desired, the oven enclosure 19 can be moved to the withdrawn position shown in FIG. 3 and a cooking fire generated in each of the fire chambers 13—15 permitting full use of the grate 16 for broiling and the full surfaces of the first and second griddle plates 17, 18 for frying Obviously, many modifications and variations of the present invention are possible in light of the above teachings. It is to be understood, therefore, that the invention can be practiced otherwise than as specifically described.

What is claimed:

1. A camp stove comprising:

an open metallic framework defining below it first and second auxiliary fire area and a primary fire area disposed therebetween, said fire areas including a source of fire;

a metallic grate supported by said open framework above said primary fire area;

a first metallic griddle plate supported by said open framework and slidable thereon between one position above said first auxiliary fire area and another position over and directly adjacent to said grate; and a second metallic griddle plate supported by said open framework above second auxiliary fire area.

2. A stove according to claim 1 including a first handle secured to said first griddle plate at an end thereof opposite to said second grill.

3. A stove according to claim 2 a second handle secured to said second griddle plate at an end thereof opposite to said first grill.

4. A stove according to claim 1 including a metallic enclosure supported by said open framework and slidable thereon between a position below said second grill and a position projecting from said framework in a zone spaced from said fire area said enclosure adapted for use as a warming oven.

5. A stove according to claim 4 wherein said enclosure comprised a door providing access thereto.

6. A stove according to claim 5 including a first handle secured to said first griddle plate at an end thereof opposite to said second griddle plate.

7. A stove according to claim 6 including a second handle secured to said second griddle plate at an end thereof opposite to said first griddle plate.

8. A stove according to claim 1 wherein said open framework comprises an upper frame supporting said first and second griddle plates and said grate, a plurality of legs each have one end fixed to said upper frame, and a lower frame including elongated members fixed to opposite ends of said legs and adapted to support said stove on a ground surface.

* * * * *